United States Patent [19]

McCarthy

[11] Patent Number: 4,884,709

[45] Date of Patent: Dec. 5, 1989

[54] UNDERGROUND STORAGE TANK

[75] Inventor: Walton McCarthy, Northwood, N.H.

[73] Assignee: Theta Technologies, Inc., Concord, N.H.

[21] Appl. No.: 294,717

[22] Filed: Jan. 9, 1989

[51] Int. Cl.[4] ..... B65D 6/02; B65D 88/04

[52] U.S. Cl. ..... 220/5 A; 220/1 B; 220/18; 220/415

[58] Field of Search ..... 220/1 B, 5 A, 5 R, 18, 220/85 S, 415, 444

[56] References Cited

U.S. PATENT DOCUMENTS

| | | | |
|---|---|---|---|
| 1,336,439 | 4/1920 | Ostrander . | |
| 2,056,179 | 10/1936 | Fitch . | |
| 2,413,243 | 12/1946 | Neff | 220/18 |
| 2,736,449 | 2/1956 | Bruderer . | |
| 3,608,204 | 9/1971 | Ashby | 220/1 B |
| 3,776,414 | 12/1973 | Baker . | |
| 4,004,706 | 1/1977 | Guldenfels et al. | 220/5 A |
| 4,068,777 | 1/1978 | Humphrey et al. | 220/18 |
| 4,071,161 | 1/1978 | Gilbu | 220/1 B |
| 4,375,860 | 3/1983 | Greaves, Jr. | 220/1 B |
| 4,552,281 | 11/1985 | Schneider | 220/5 A |
| 4,557,199 | 12/1985 | Everett, Jr. . | |
| 4,685,585 | 8/1987 | Robbins . | |

*Primary Examiner*—Jimmy G. Foster
*Attorney, Agent, or Firm*—Leonard Belkin

[57] ABSTRACT

An underground storage tank comprising a paraboloidal or ellipsoidal shaped vessel of fiberglass construction with an opening at the top through a neck. The vessel is provided with a yoke around the waist to permit cradling and handling, and a containment cell is mounted on top of the neck to provide access from ground level. Within the containment cell are provided all of the pipes and fittings required in connection with the use of the tank.

15 Claims, 3 Drawing Sheets

UNDERGROUND STORAGE TANK

BACKGROUND OF THE INVENTION

This invention relates to an underground storage tank and more particularly to an underground storage tank for use in storing liquids safely under a variety of conditions for extended periods of time.

Today there are hundreds of different chemicals stored literally in thousands of underground tanks, such as fuel oils, lubricants, gasoline, and other chemicals some of which are highly toxic or explosive and a direct threat to persons and property once out of their tanks. In many cases, the tanks have been in place for thirty years of longer.

The typical tank which has been used for such storage is made out of steel. Although steel tanks can be designed with cathodic protection, such design does not prevent corrosion from soil pH, de-icing salts, runoff from septic tanks, internal rust on the inside of the tank, or rust between the wall of double wall tanks due to condensation. As a result, there has been a steady growth in the incidence of tank failure resulting in leaks many of which have the capability of damaging the environment and contaminating underground water supplies as well as causing injury to the property of home owners, businesses, and the general public.

The problem is especially acute for tanks in which petroleum products are stored as such products contain a number of carcinogenic compounds such as benzine, zyline, and toluene. This problem is experienced throughout the world and is not limited to the United States.

If leaking and overage tanks are merely replaced by tanks of the same or similar design then of course the problems mentioned above are merely programmed for recurrence.

There have been efforts to improve underground tank design to avoid or minimize some of the problems mentioned above, and consequently tanks made out of fiberglass reinforced plastic (FRP), such as used in the manufacture of boat hulls, and which may be referred to hereinafter merely as fiberglass, have come into some use due to the resistance of this material to corrosion.

The steel tank typically is cylindrical in configuration, and fiberglass has been substituted for steel while retaining the cyclindrical shape. But the mere substitution of fiberglass for steel in the construction of such tanks has introduced a whole set of new problems. Present design of tanks made of fiberglass tend to be fragile and are highly susceptible to damage during shipping and installation. The cylindrical tank made out of fiberglass performs underground like a flexible conduit and relies on the surrounding soil to maintain its shape. If not evenly backfilled a tank of such design can collapse therefore requiring a very careful and expert installation which increases the cost of installing such tanks.

In addition, according to studies by the EPA, about 70% of reported tank leaks are due to failures in piping or pipe fittings so that substitution of fiberglass for steel in the wall construction would only reduce the incidence of leaks in the remaining 30% of reported tank leaks as the piping and fittings can not be made out of the fiberglass.

U.S. Pat. Nos. 1,336,439, 2,056,179, 2,736,449, 3,776,414, 4,557,199, and 4,685,585 show typical underground tank designs pertinent to, but lack teachings of, the present invention.

SUMMARY OF THE INVENTION

In this invention there is provided an underground storage tank for liquids highly resistant to corrosion, capable of being shipped and installed with a reduced possibility of being damaged, and provides ready access to the piping and fittings making it convenient to inspect and repair any leaks. In addition, the ellipsoidal and paraboloidal shapes provide greater strength than cylindrical shapes now on the market. By ellipsoid or ellipsoidal shape herein is meant to include the spheroid or spheroidal shape.

In accordance with a preferred embodiment of this invention there is provided an underground storage tank shaped as an ellipsoid or paraboloid made out of fiberglass reinforced plastic (FRP) with a yoke serving all of the functions of reinforcement, lifting ring, tie down, and shipping cradle. In addition, the underground tank constructed in accordance with the principles of this invention includes features to prevent overfilling and provides access to the piping and fittings on site inspection and repair if necessary.

It is therefore a principal object of this invention to provide an underground storage tank for liquids having improved resistance to corrosion and damage during shipping and installation.

It is another object of this invention to provide an underground storage tank for liquids capable of remaining leak tight for periods beyond what is currently available.

Still another object of this invention is an underground storage tank for liquids having in situ access for the inspection and repair of piping and fittings.

Other objects and advantages of this invention will hereinafter become obvious from the following description of preferred embodiments of this invention.

DETAILED DESCRIPTION OF THE PREFERRED EMBODIMENTS

Figure 1:
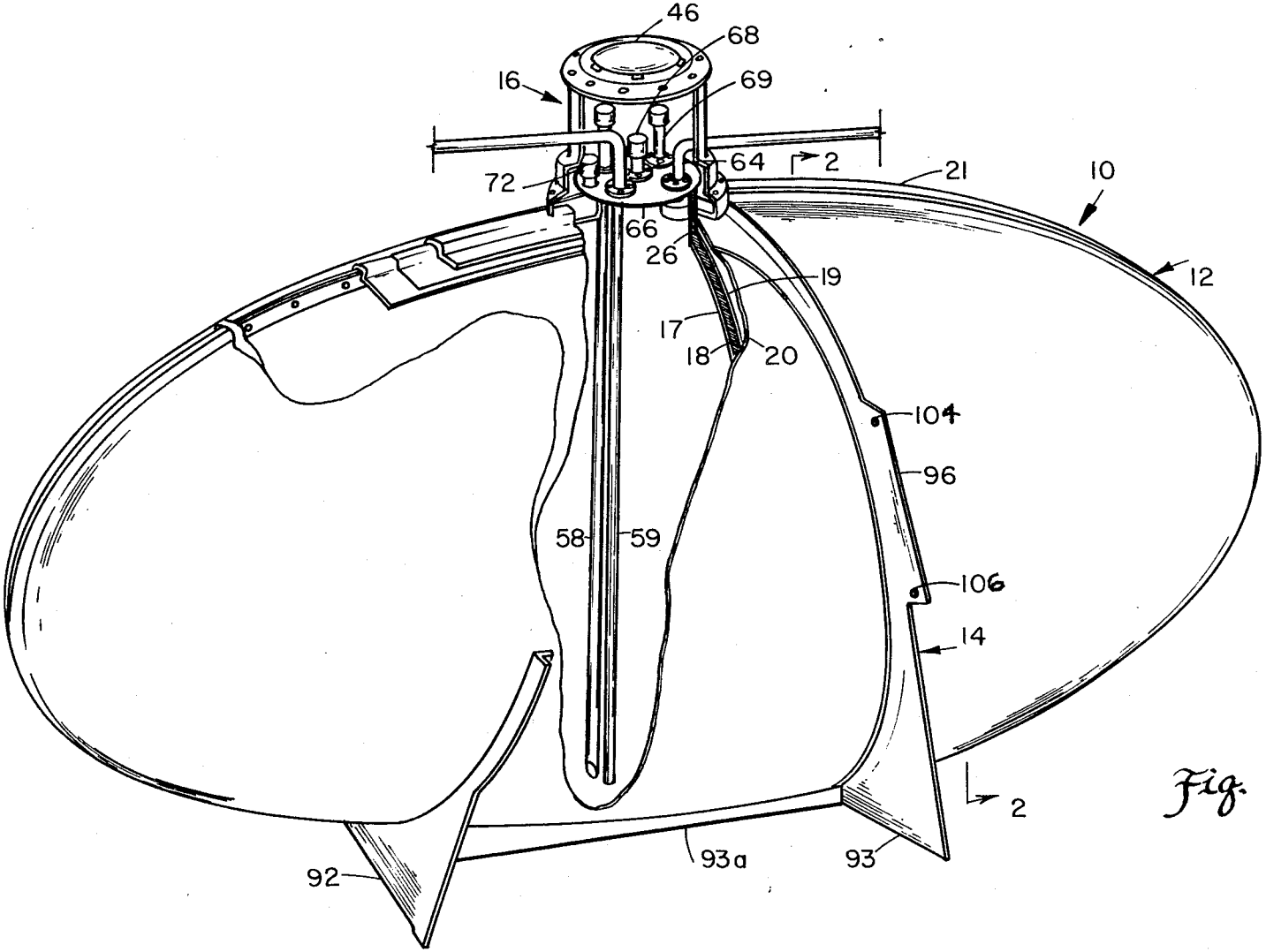
FIG. 1 is an isometric view, partially cut away, of a preferred embodiment of this invention.
Figure 2:
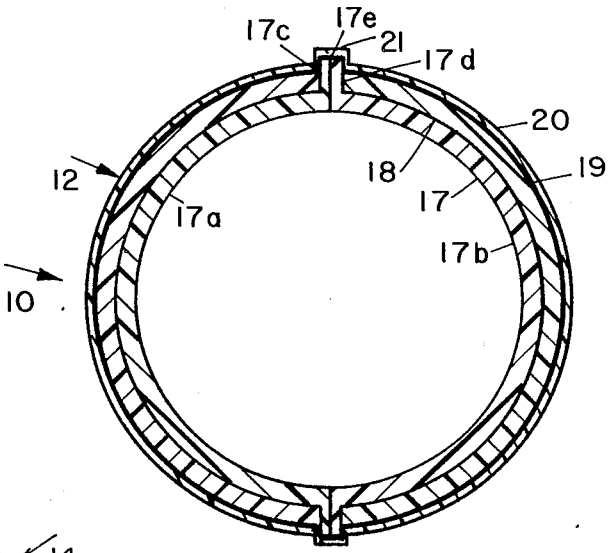
FIG. 2 is a section along 2—2 of FIG. 1.

Referring to FIGS. 1 and 2, underground storage tank 10 consists of a hollow paraboloidal, spheroidal or ellipsoidal vessel 12, yoke 14, and containment cell 16.

Vessel 12 is a conic section of rotation by which is meant herein a geometric figure formed by cutting a right angle cone with a plane not parallel to the base and rotating the section. This definition is meant herein to include a paraboloid, ellipsoid, and a spheriod.

As seen in FIG. 1, vessel 12 is constructed from an inner wall 17 made out of FRP, a layer 18 to be more particularly described below, a film 19, and an outer wall 20.

As also seen in FIG. 2, inner wall 17 is constructed of two clam-like halves **17*a* and 17*b*** with matching flanges 17*c* and 17*d* forming an external rib 17*e* extending the full circumference of tank 10 along its long dimension as seen in FIG. 1. Flanges 17*c* and 17*d* are bonded and bolted together and form the strongest part of vessel 12. This mechanical design assures absolute structural integrity, tightness, and shape, and is thus able to resist high static and dynamic loads. Also, this allows tank 10, when assembled as hereinafter described, to be delivered completely finished for many products requiring only the supply lines to be attached.

Over wall 17 is placed a layer 18 which consists of an open-celled insulation material such as an open cell foam, aluminum or stainless steel wire mesh, or segments or blocks of balsa core material bonded on a mat and very close to each other. When balsa core blocks are used to create the interstitial space between the walls of tank 10, there should be spaces between the blocks. Balsa has the advantage of being extremely strong with a proven track record over many years in the boating industry.

Film 19 is a sheet of any suitable non-porous plastic material such as Mylar which seals in the open foam insulation and provides a mold surface for layer 20. The latter consists of a suitable non-porous material such as a fiberglass woving roving and chopped strand which is sprayed over film 19 as is understood in the art. Film 19 prevents the resin from penetrating layer 18. In this way the integrity of the open cells in layer 18 is maintained and the outer wall of vessel 12 is a seamless and jointless covering with an outer flange 21 extending the full circumference of tank 10 along its long dimension.

Figure 3:
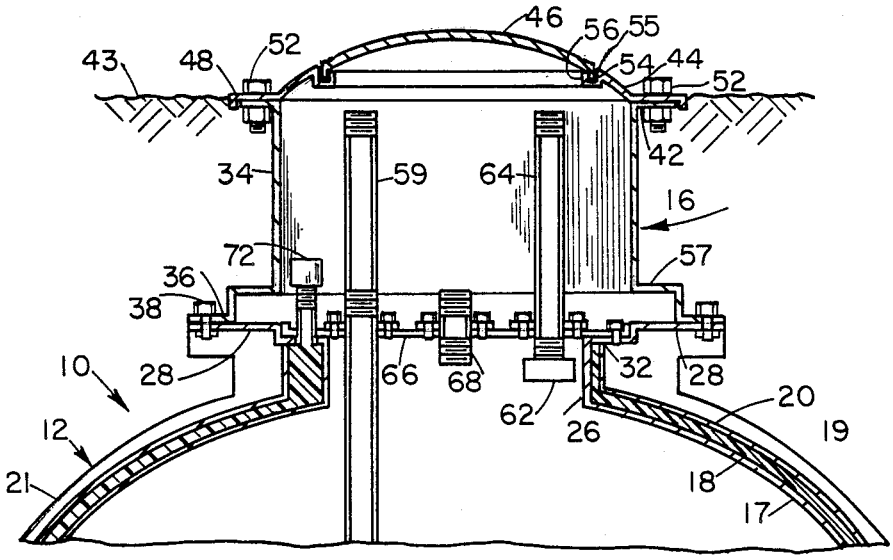
FIG. 3 is a detail in section of the containment cell for the tank shown in FIG. 1 without the yoke.

Referring to FIG. 3 as well as FIG. 1, located substantially at the midpoint of vessel 12 is an opening formed by a neck 26 perpendicular to the long axis of vessel 12. It will be noted that inner wall 17 forms the inner wall of neck 26 and at the top of the opening forms an outwardly extending flange 28 which will be described below in connection with containment cell 16. It will be noted, however, that outer wall 20 forms the outer wall of neck 26 and is joined at the top designated by numeral 32 to flange 28 to seal the space between walls 17 and 20 containing layer 18 having the open cells.

The paraboloidal, spheroidal, or ellipsoidal shape of vessel 12 renders the latter as stable and strong as a spherical shape but does not require the excavation to be as deep as that which would be required for a sphere having the same volume. An advantage of the paraboloid, spheroid, or ellipsoid shape over the cylindrical shape which is typical of tank design today, is that reinforcing ribs which introduce stress concentrations and tie downs are not required. Another advantage over the cylindrical shape is that an agitator placed near the bottom of the vessel is a more effective mixer than in the cylindrical tank. In addition, the back fill problem as described above in connection with the use of fiberglass in cylindrical constructions is totally avoided since the curved shape avoids the need for even backfilling.

Another major advantage of the paraboloidal, spheroidal or ellipsoidal shapes is that they are very strong because they are curved on the X, Y, and Z axes and do not fail catastrophically. Because a sphere is very rigid, it must absorb the overlaying loads from earth and traffic, thus the load travels through the sphere. For the ellipsoid, spheroid or paraboloid, these shapes allow flexing on the vertical axis and thus are able to take advantage of the arching effect which occurs when the structure flexes, resulting in some of the load travelling around the structure and not through it like the sphere.

Figure 4:
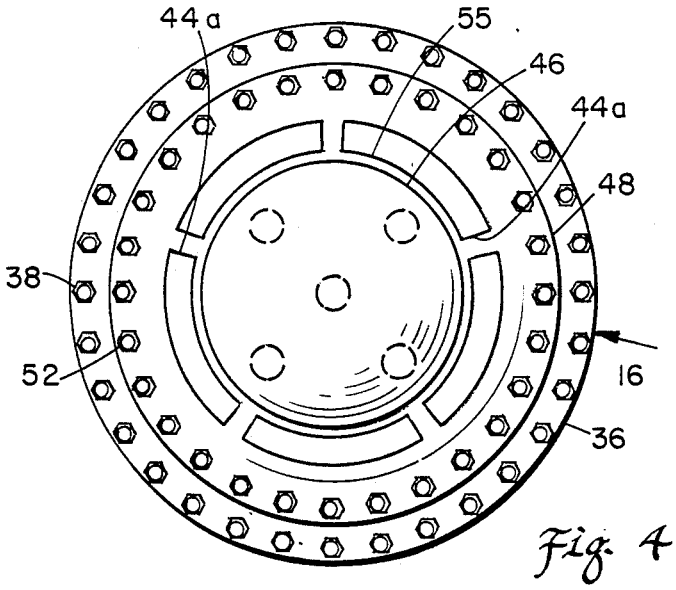
FIG. 4 is a top view of the containment cell shown in FIG. 3.

As best seen in FIGS. 3 and 4, containment cell 16 provides the communication with the interior of vessel 12. Cell 16 is of fiberglass construction and consists of a vertically extending cylindrical member 34 open at the top and bottom. The bottom of cylindrical member 34 is provided with a flange 36 which lies flush against and is bolted to flange 28 of vessel 12 using bolts 38.

The top of member 34 is provided with a flange 42 which is located, for a typical installation, at or just below ground level 43. A containment cover 44 with an opening and a lip 55 surrounding the opening has a ready access cover 46. Cover 44 covers the opening with a flange 48 connected to flange 42 by a plurality of annularly distributed bolts 52. Ready access cover 46 is a simple pop on device with a rim 54 which pops into an annular groove 56 formed in cover 44. Cover 44 may be provided with a plurality of recesses 44*a* to permit cover 46 to be lifted when it is desired to gain access to the interior of containment cell 16.

In the event tank 10 is installed in an area where there will be traffic over containment cell 16, covers 44 and 46 may be constructed of steel.

An annular, L-shaped flexible joint 57 is formed in the wall of cylindrical member 34 to absorb forces which might otherwise be transmitted from the top of containment cell 16 to vessel 12, due to the shifting of the ground, a load on cover 44, etc.

The opening within cylindrical member 34 when cover 44 is removed is large enough to accomodate a worker if it is necessary to make use of that kind of access for example, to undertake repairs and modifications within cell 16 or to gain physical entry into vessel 12. The opening provided by the removal of ready access cover 46, however, is just enough to permit the insertion or withdrawal of chemical within vessel 12 or to view the interior of cell 16, or accomplish routine maintenance, inspection, or minor repairs on the exposed plumbing. It is believed that, in normal operation, this is the only kind of access that will be needed.

Within cell 16 are located supply and fill tubes 58 and 59 and a tank alarm 62 mounted on the bottom of a tube 64. The purpose of alarm 62 is to emit a signal when the liquid level within vessel 12 reaches the alarm thereby warning that the tank is full. Such alarms are conventional and readily available. A plate 66 is mounted on neck 26 of vessel 12 covering the opening as is illustrated and tubes 58, 59, and 64 are mounted as shown to penetrate said plate 66. Plate 66 is readily removable where access to the interior of vessel 12 is required. In addition, a sight tube 68, which can be utilized for measuring directly the level of the liquid within vessel using a stick, is also mounted to penetrate plate 66. A sensor 72 may be mounted in communication with layer 18 through plate 66 for monitoring pressure, vacuum, or liquid for the detection of any leaks in the inner or outer walls, 17 and 20, respectively. A tube 69 may be employed for venting.

Figure 5:
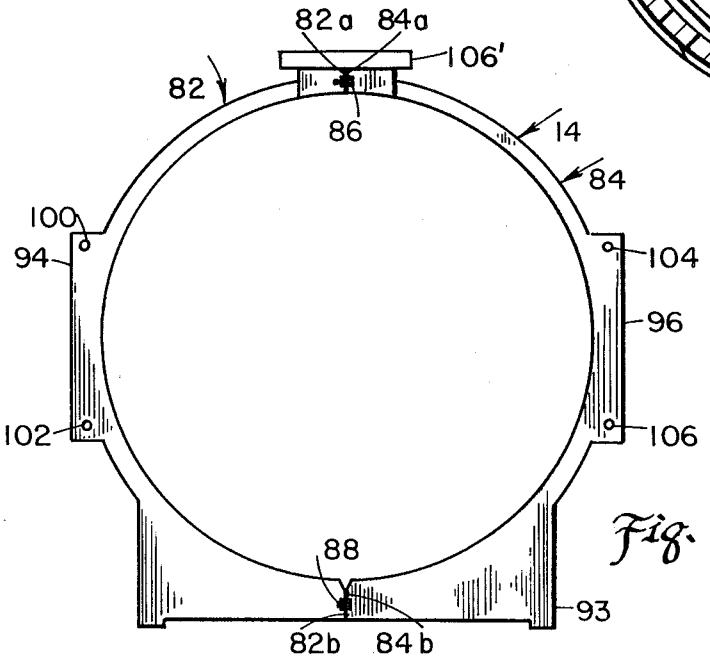
FIG. 5 is a left end elevation view of the yoke shown in FIG. 1.
Figure 6:
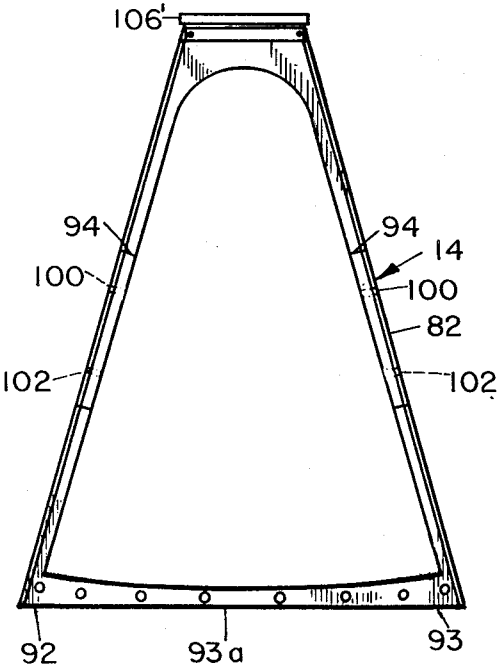
FIG. 6 is a left side elevation view of the yoke shown in FIG. 5.

Vessel 12 is supported by yoke 14 surrounding the waist of vessel 12, and which as seen in FIGS. 1, 5 and 6, is made of two members 82 and 84 bolted together through flanges 82*a*, 82*b* and 84*a*, 84*b*, respectively, at the top and bottom, as shown, by a pair of bolts 86 and 88.

When members 82 and 84 are joined there are formed a pair of cradles 92 and 93 to support tank 10 on a flat surface such as the bed of a truck or the bottom of an excavation. Member 82 has a pair of thickened sections 94 for lifting (from holes 100) and tie down (from holes 102). Member 84 is provided with similar thickened sections 96 with holes 104 and 106. The top of yoke 14 is provided with a collar 106' fitting under flange 28 and through which neck 26 of vessel 12 passes and shaped to accomodate outer flange 21.

Yoke 14 encloses vessel 12 in such a way that this single configuration provides for handling of the container, supporting the container while in transit and leveling, as mentioned, when inserted into an excavation for installation, and tie down should that prove to be necessary. Yoke 14 takes the place of the usual tie down straps which have been known to slice a tank when not full and becomes buoyant under certain conditions.

Yoke 14 is L-shaped in cross section as illustrated and is also made from fiberglass reinforced plastic (FRP) and bonded with structural expoxy to vessel 12.

For tanks of small volume, 4000 gals. and less, instead of yoke 14 a simple three point base may be employed.

In the use of tank 10, the tank is manufactured and delivered complete and ready for immediate use in the form shown in FIG. 1. During shipment, cradles 92 and 93 support tank 10 and tie down holes 102 and 106 are used to keep it from moving. A hole is excavated which is large enough to accomodate the tank which is then lowered into the hole using lifting holes 100 and 104 with the top of neck 26 at or about ground level as illustrated in FIG. 3. Then the ground is backfilled so that only cover 44 is visible at ground level. To insert the liquid to be stored within the tank, ready access cover 46 is lifted and filling is commenced through tube 58. After filling, cover 46 is then put back in place as shown in FIG. 3. To remove some chemical, the procedure is repeated, except that the liquid is pumped out by suction through tube 59.

Tank 10 is not as fragile as conventional fiberglass tanks and may be handled with the same degree of care required for the conventional steel tank. All of the metal parts which might wear out or fail due to corrosion over a period of years are readily accessible within the containment cell 16. The use of cover 44 makes it possible to provide access when a major job of repair is required, even permitting a worker to enter the cell if the tank is large enough.

The underground storage tank as described herein is suitable for use in storing chemicals, petroleum products, potable water, sewage, waste oil, etc.

While only a certain preferred embodiment of this invention has been described it is understood that many variations are possible without departing from the principles of this invention as defined in the claims which follow.

What is claimed is:

1. An underground liquid storage tank comprising:

a. a hollow, elongated vessel comprising a wall which is a conic section of revolution;

b. said wall comprising an inner layer formed from a pair of clam shell rigid fiberglass reinforced plastic sections having rims bolted and cemented together forming a flange extending around the long dimension of said vessel, a layer of open celled material surrounding said inner layer, a liquid tight film enveloping the layer of opencelled material and said rims, and an outer layer of non-porous material sprayed on said film to form a seamless outer surface on said vessel;

c. opening means into said vessel perpendicular to the long axis of said vessel located substantially at the midpoint of said vessel; and d. cell means containing all of the pipes and fittings associated with said vessel surrounding and attached to said neck comprising closure means located at or near ground level when said tank is installed for providing access to said pipes and fittings and said neck for supplying or withdrawing contents to or from said vessel.

2. The underground tank of claim 1 having yoke means extending around the waist of said vessel including means for supporting said vessel on a flat surface, means for permitting said tank to be lifted, and means for permitting said tank to be tied down.

3. The underground tank of claim 2 in which said yoke means is made of fiberglass reinforced plastic and bonded with structural epoxy to the walls of said vessel.

4. The underground tank of claim 1 in which said open celled material consits of balsa.

5. The underground tank of claim 1 having means within said cell means for detecting any leaking through either the outer or inner layers of said wall.

6. The underground tank of claim 1 in which said closure means comprises a containment cover which upon removal permits access to said neck to permit repair or maintainance, said containment cover includng an access cover to permit separate limited access for filling and withdrawing of liquid within said tank.

7. The underground tank of claim 1 in which said cell means includes means for absorbing forces imposed on said cell means and preventing said forces from being transmitted to said vessel.

8. The underground tank of claim 1 in which said cell means includes means to sense when said vessel is full.

9. The underground tank of claim 1 in which said vessel is a paraboloid.

10. The underground tank of claim 1 in which said vessel is an ellipsoid.

11. The underground tank of claim 1 in which said vessel is a spheroid.

12. The underground tank of claim 1 in which the top of said opening means includes a first flange, the bottom of said cell means having a second flange attached to said first flange.

13. The underground tank of claim 11 having a cover plate extending across the top of said opening means, said cover plate supporting said pipes and fittings within said cell means.

14. The underground tank of claim 13 in which the top of said cell means terminates in a third flange, said closure means having a fourth attached to said third flange.

15. The underground tank of claim 14 in which said closure means includes a removable ready access cover to permit withdrawal or supply of liquid without removal of said closure means.

* * * * *